US009570051B1

(12) United States Patent
Moore et al.

(10) Patent No.: US 9,570,051 B1
(45) Date of Patent: Feb. 14, 2017

(54) ORGANIC SOUND TEXTURE ENHANCEMENT AND BRIDGE STRENGTHENING SYSTEM FOR ACOUSTIC GUITARS AND OTHER STRINGED INSTRUMENTS

(71) Applicants: Dwaine Moore, Arnold, PA (US); Joseph S. DeSimone, Arnold, PA (US); Ralph A. DeSimone, Arnold, PA (US)

(72) Inventors: Dwaine Moore, Arnold, PA (US); Joseph S. DeSimone, Arnold, PA (US); Ralph A. DeSimone, Arnold, PA (US)

( * ) Notice: Subject to any disclaimer, the term of this patent is extended or adjusted under 35 U.S.C. 154(b) by 0 days.

(21) Appl. No.: 15/171,169

(22) Filed: Jun. 2, 2016

Related U.S. Application Data

(60) Provisional application No. 62/233,971, filed on Sep. 28, 2015.

(51) Int. Cl.
*G10D 3/02* (2006.01)
*G10D 3/04* (2006.01)

(52) U.S. Cl.
CPC . *G10D 3/02* (2013.01); *G10D 3/04* (2013.01)

(58) Field of Classification Search
CPC ..... G10D 3/04
See application file for complete search history.

(56) References Cited

U.S. PATENT DOCUMENTS 685,920 A * 11/1901 Heck ..... G10D 3/02 84/294
729,230 A * 5/1903 Smith ..... G10D 3/02 84/277
1,123,946 A * 1/1915 Steuer ..... G10D 3/02 84/277
1,539,961 A * 6/1925 Scott ..... G10D 3/02 181/181
1,560,372 A * 11/1925 Berge ..... G10D 1/10 84/270
1,695,783 A * 12/1928 Stephenson ..... G10D 3/02 84/277
1,711,386 A * 4/1929 Hey ..... G10D 3/02 84/294
1,798,048 A * 3/1931 Ungrich ..... G10D 3/02 84/294
1,961,900 A * 6/1934 Gast ..... G10D 3/02 84/294
2,029,469 A * 2/1936 Dopyera ..... G10D 3/02 84/296
2,039,227 A * 4/1936 Korhonen ..... G10D 3/02 84/296
2,042,080 A * 5/1936 Turner ..... G10D 3/02 84/296
2,060,357 A * 11/1936 Williams ..... G10D 3/02 84/296
2,158,322 A * 5/1939 Dopyera ..... G10D 3/02 84/296

(Continued)

*Primary Examiner* — Robert W Horn
(74) *Attorney, Agent, or Firm* — Gary P. Topolosky

(57) ABSTRACT

A sound resonator device for internal connection to a guitar or other musical instrument that has strings tensioned over any type of bridge piece. The resonator device includes a torsion arm affixed to a sound board of the instrument from which is connected a plurality of involute coil sets, each made from a harmonically predetermined thickness (or gauge) of metal wire secured at its opposite end to the instrument interior.

18 Claims, 4 Drawing Sheets

(56) References Cited

U.S. PATENT DOCUMENTS

| | | | | | |
|---|---|---|---|---|---|
| 3,233,495 | A * | 2/1966 | Bernardi | G10D 3/02 | 84/294 |
| 3,314,324 | A * | 4/1967 | Williams | G10D 3/02 | 84/294 |
| 3,435,721 | A * | 4/1969 | Rudolph | G10D 3/02 | 84/292 |
| 3,678,794 | A * | 7/1972 | Tansky | G10D 3/02 | 84/275 |
| 3,956,963 | A * | 5/1976 | Milton | G10D 3/02 | 84/296 |
| 4,762,046 | A * | 8/1988 | Aspri | G10K 15/10 | 84/294 |
| 5,567,895 | A * | 10/1996 | Aspri | G10K 15/08 | 84/294 |
| 5,567,896 | A * | 10/1996 | Gottschall | G10D 3/02 | 84/294 |
| 5,581,043 | A * | 12/1996 | Bowar | G10D 3/02 | 84/291 |
| 6,040,510 | A * | 3/2000 | Yaun | G10D 3/02 | 84/294 |
| 6,681,661 | B2 * | 1/2004 | Lalonde | G10D 3/02 | 84/267 |
| 6,861,581 | B2 * | 3/2005 | Geiger | G10D 3/02 | 84/267 |
| 7,259,308 | B2 * | 8/2007 | Geiger | G10D 3/02 | 84/267 |
| 7,847,169 | B2 * | 12/2010 | Umeda | G10D 3/02 | 84/267 |
| 8,969,692 | B2 * | 3/2015 | Sanns, Jr. | G10D 3/12 | 84/291 |
| 8,975,497 | B2 * | 3/2015 | Aspri | G10D 3/02 | 84/294 |
| 9,196,230 | B1 * | 11/2015 | Elliot | G10D 3/02 | |
| 9,361,862 | B2 * | 6/2016 | Klemarewski | G10H 3/186 | |
| 9,396,707 | B1 * | 7/2016 | Clark | G10D 1/08 | |
| 2006/0230904 | A1 * | 10/2006 | Ribbecke | G10D 1/02 | 84/294 |
| 2007/0234872 | A1 * | 10/2007 | Cody | G10D 3/02 | 84/291 |
| 2010/0083806 | A1 * | 4/2010 | Peavey | G10D 3/02 | 84/294 |

* cited by examiner

ORGANIC SOUND TEXTURE ENHANCEMENT AND BRIDGE STRENGTHENING SYSTEM FOR ACOUSTIC GUITARS AND OTHER STRINGED INSTRUMENTS

CROSS-REFERENCE TO RELATED APPLICATION

This is a perfection of Provisional Application Ser. No. 62/233,971, filed on Sep. 28, 2015, the disclosure of which is fully incorporated by reference herein.

FIELD OF THE INVENTION

The present invention relates to acoustic guitars and other stringed instruments. More particularly, it relates to a sound resonator device conveniently secured to the interior of a stringed musical instrument for enhancing the textural sounds achievable from playing that instrument. It may be assembled into the manufacture of new musical/audio products or carefully inserted into the retrofit/repair of existing guitars and other stringed instruments.

The resonator device of this invention rests in constant tension in a coiled and layered configuration. The device uses a uniquely designed waveform that is purposed to pull IN on itself, in an accordion-like fashion. The device attaches through a torsion arm mechanical interface that allows it to indirectly connect to any given plurality of the instrument's strings. Installation of this device also nullifies a sizeable percentage of the high torque stresses that strings normally impart to the bridge regions of such instruments thereby greatly reducing fatigue and warping of the soundboard.

BACKGROUND OF THE INVENTION

To enhance the tonality of the sound box of a musical instrument, one may incorporate a common household spring that responds to the vibrations of its strings to give some resonant effect and modify the tones generated by plucking, strumming, striking or otherwise vibrating these strings.

It is further known in another design, that one might secure a large spring device to the frame of a guitar and suspending that spring vertically above the guitar strings over the outside top wall of the sound box and at a location in front of the bridge piece. A loop at the free end of this spring connects directly to two strings and vibrates with the strings to enhance the sound from the instrument. That spring device can be removed or disconnected if the original sound from that instrument is desired. Such a spring device has many disadvantages, however. It is unsightly; it intercepts string energy before it can benefit the soundboard, and is difficult to install. Known (large) spring connections are quite cumbersome. They also obstruct an area of the instrument where the user places his/her hand to pluck or otherwise activate the strings.

Relevant art to the present invention also includes the following disclosures, arranged chronologically: Sanns, Jr. U.S. Pat. No. 8,969,692, Aspri U.S. Pat. No. 8,222,503, LaMarra U.S. Pat. Nos. 7,838,752 and 7,488,878, Chiliacki U.S. Pat. No. 7,259,318, England U.S. Pat. No. 6,982,372 and Martin U.S. Pat. No. 6,646,191.

SUMMARY OF THE INVENTION

It is a feature of the present invention to provide an improved sound reverberator device, particularly, one that permanently connects to the interior of a guitar (or other stringed instrument) at or below the sound bridge to that instrument. This invention would be easy to install in the manufacture of new products but can, with some degree of care, be added to existing guitars and the like for greatly enhancing the tonality of sound emanating from that instrument and greatly prolonging the life of its bridge/soundboard.

From a broad aspect, the present invention provides sound resonance by connecting to the guitar's interior a plurality of specially shaped pre-load coils, each coil wrapping outwardly and then back inwardly about itself to form a section of resonation, with each pair of guitar strings having at least one resonator "set" comprised of a plurality (one or more) sections of spiraled resonator coils arranged IN SERIES and connected at one end to the underside, beneath the sound bridge of the instrument.

These multiple sets of coiled wire sections are secured between the guitar face and backing. Each coiled set of resonators would connect to the underside of the guitar's top soundboard, nearest the sound bridge, using a resonator torsion arm.

BRIEF SUMMARY OF THE DRAWINGS

Further features, objectives and advantages of the present invention will be clearer with the following detailed description made with reference to the accompanying drawings and photographs in which.

DETAILED DESCRIPTION OF PREFERRED EMBODIMENTS

From a broad aspect, the present invention provides sound resonance by connecting to the guitar's interior a harmoniously selected, plurality of specially shaped coils, each coil wrapping in an involute manner, i.e., outwardly and then back inwardly about itself, to form an accordion-like section of resonation, with each guitar string affiliated with at least one resonator "set" comprised of multiple sections (three or more) of spiraled resonator coils arranged IN SERIES and connected via a rotatable (angled) torsion bar (made of wood or metal) to the lower end, underside, of the sound bridge of the instrument.

One embodiment for a six-string guitar would have a first involute coil for the first two strings, a second coil set for the middle two strings and a third, separate coil for the last two strings of the guitar. Alternately, a first coil set could be dedicated to its own string of the guitar, a second coil to a pair of strings and a third coil set affiliated with the remaining THREE strings of the same acoustic instrument.

Figure 4:
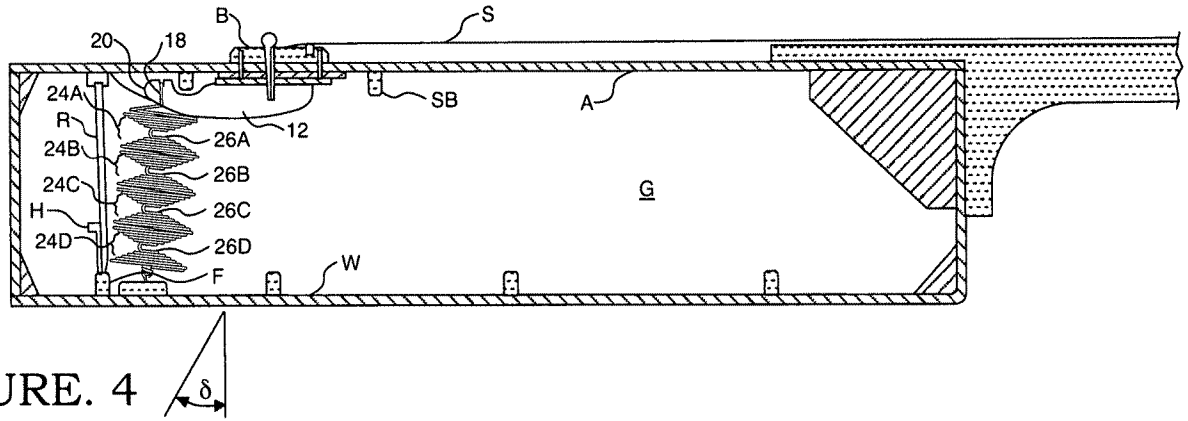
FIG. 4 is a side sectional view of a first alternative embodiment showing a connecting rod-mounted variation of coil section attachment.

These multiple sets of coiled wire sections are secured between the guitar face and backing. Each coiled set of resonators would connect to the underside of the guitar's top soundboard, nearest the sound bridge, using a resonator torsion arm. That arm can be made from wood or metal and mounted to the underside at an angle α (in FIG. 1) ranging from about 5 to 175 degrees from the horizontal plane of that sound bridge. A second angle of tilt, angle β in FIG. 3, ranging from about 5 to 89 degrees on either side of perpendicular, may be used for preferential positioning of any one or more torsion arms relative to the longitudinal directional plane of guitar string attachment to that same sound bridge. Yet a third angle, δ in FIG. 4, shows the relative mounting of the involute coil sets from the innermost face of the instrument to its lowermost connecting point (either directly to the rear wall of the guitar or via connecting pins to a rearward most mounting point). That third angle is typically perpendicular to the sound bridge and rear wall in most instances. But it can also vary by as much as 45 degrees, preferably 30 degrees or less, tilted away from perpendicular.

While the respective involute coil sets can be made in individual units and connected, in series, to one another, it is preferred that they instead be made as one continuous unit of outward then inward windings and un-windings of metal wire.

In one preferred embodiment, a first set of involute sections, made from a finer gauge of metal wire (about 0.009" to about 0.052" diameter) could connect to the B and high E strings of a standard six-string guitar. The second set of coiled resonator (stacked) sections, made from a thicker gauge of wire (about 0.028" to about 0.088" diameter) would be joined, via a second torsion arm, to the middle two strings, the D and G strings with a third, larger still set of stacked resonator coils (made from the largest of the three wire gauges employed hereby, about 0.042" to about 0.125" diameter) connecting to the last remaining strings, the low E and A strings of a standard 6-string acoustic.

For 12 string guitars, for example, additional sets of resonators may be added. And for instruments with fewer than six strings, a banjo, violin, bass, etc., there may be acceptable reductions (or increases) in the number of resonators installed thereunder.

There will be some preferred materials of choice to make respective SETS of involute resonator coils but certainly, as one preference, all three sets may be made from a common metal/metal alloy, in different thicknesses of wire product, specially coiled outwardly then intentionally inwardly, with the coil "wave frequency" (or pitch) varying, even within any given coil. Suitable wire materials for these reciprocating coil windings can be made in harmoniously matched sets, just as the surface strings of the instrument proper are in matched sets, made from stainless steel, medium carbon steels, phosphorus bronze, copper, aluminum or brass. Other materials may be customizable therefrom based on cost of manufacture versus desired degree of sound improvement sought.

Figure 1:
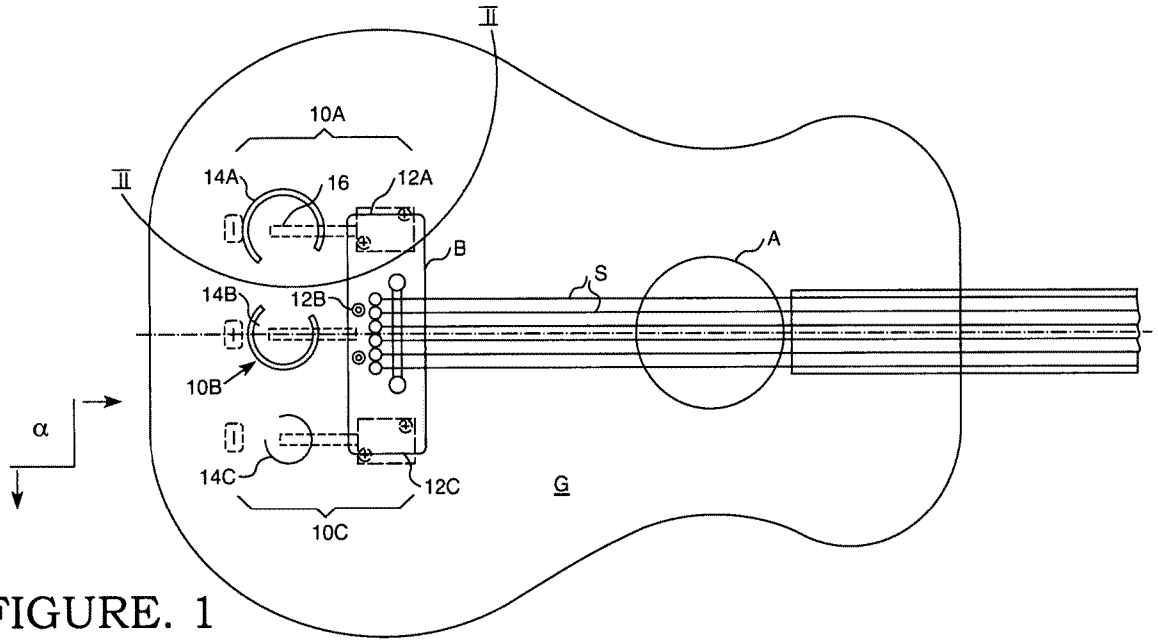
FIG. 1 is a top plan view of the lower end of an acoustic guitar showing three interior coil connections per one embodiment of this invention.
Figure 2:
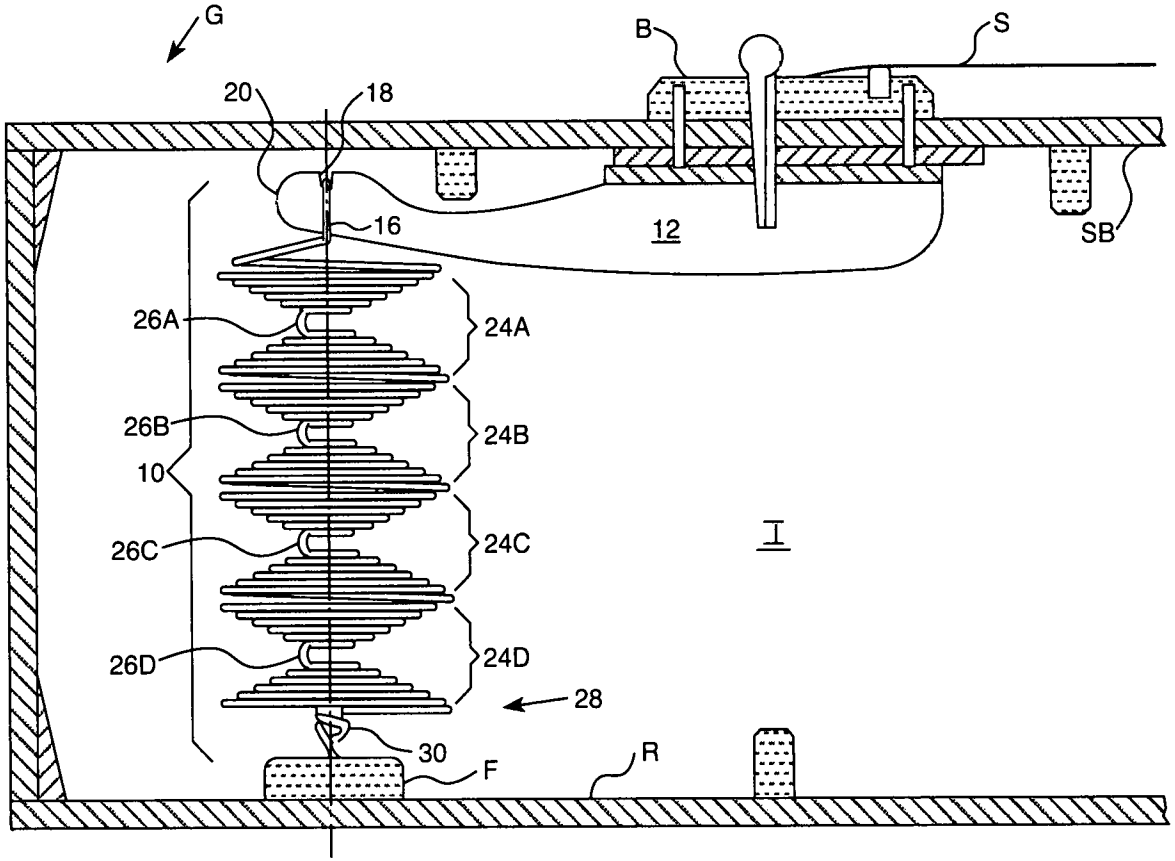
FIG. 2 is an enlarged side sectional view taken along lines II-II of FIG. 1.

Referring now to FIGS. 1 and 2, there is shown a first embodiment of sound resonator device 10 having a torsion arm 12 and plurality of involute coils 14 secured at one end, the first or upper end 16 of coils 14, to a V-groove 18 in a first end 20 of torsion arm 12. An opposite end 22 of that torsion arm 12 mounts to the lower interior I of an acoustic, six-string guitar G. In one embodiment (better seen in FIG. 1), there are three separate resonator devices 10A, 10B and 10C, connecting involute coil sets 14A, 14B and 14C, via respective torsion arms 12A, 12B and 12C to the interior I of guitar G. Beneath the soundboard SB of that guitar G, these "sets" of devices (each set including one torsion arm 12 and two involute coils 14) connect to a pair of adjoining strings S rearward of bridge piece B adjacent aperture A in the sound box of guitar G.

As better seen in FIG. 2, a given representative involute resonator coil, generally 14, may actually be comprised of a plurality (one or more) spiraling coil frequency sets 24. Actually, in FIG. 2, four such sets 24A, 24B, 24C and 24D are shown stacked one atop the other. Preferably, these frequency sets 24 are made from one continuous section of wire (having a circular diameter in cross-section), with windings inwardly to a central connection point 26 before unwinding (or spiraling) back outwardly again. FIG. 2 shows four such connection points 26A, 26B, 26C and 26D, though it is to be understood that a frequency set may actually include several more such sets and possibly even a few less than the four shown for representation purposes. It should be further noted that the wire windings making up the respective frequency sets have a circular cross-sectional diameter (not shown), but typical for most wire product. Optional variations (also not shown) may use metal wires having an oval, square, triangular or even flattened plane of wire windings.

As seen in FIG. 2, the lower end 28 to involute coil 14 may terminate in an arm hook 30 being part of a fastening block F affixed to the rear wall W of guitar G opposite soundboard SB. Still other connecting means may be used, including the alternate angled versions depicted in accompanying FIG. 4. That angle δ shows the relative mounting of involute coil sets from the top of said set (to the guitar interior I to its lowermost connecting point via a lower hook H and connecting rod R combination. In FIG. 2, that third angle is typically perpendicular to the sound bridge SB and rear wall W. But, in FIG. 4 a representative (non-perpendicular) angle is shown varying by preferably less than 30 degrees, more likely tilted about 10-25 degrees from perpendicular.

The three sets of resonators employed within the guitar shown are purposefully spaced from one another. They are NOT meant to contact each other in any manner. As mentioned earlier, it is ideal to incorporate such resonator sets in the NEW construction of a guitar. It is to be understood, however, that resonators may also be carefully inserted into an existing unit, albeit by labor intensive retrofitting.

With the sound resonator devices installed as shown, the tension applied onto the standard bridge B of a guitar G will be purposefully lessened. As for the resonators, when a string S on the guitar G is plucked, it imparts a vibration that will be transmitted to the sound box via the bridge piece B. With the invention, however, that same vibration will now be transferred, via torsion arm 12, to the involute coil set 14 for that string for a functional energy storage and retransmission. The coil set 14 is thus set into vibration and that vibration gets transmitted back and forth and eventually into either the back soundboard or the front soundboard via the connecting rod, with some residual effects re-entering the bridge area as well. The added vibration areas provide a resonant sound and amplify, give volume, prolong and further modify the tones usually generated by the vibrated string of that instrument alone.

Figure 3:
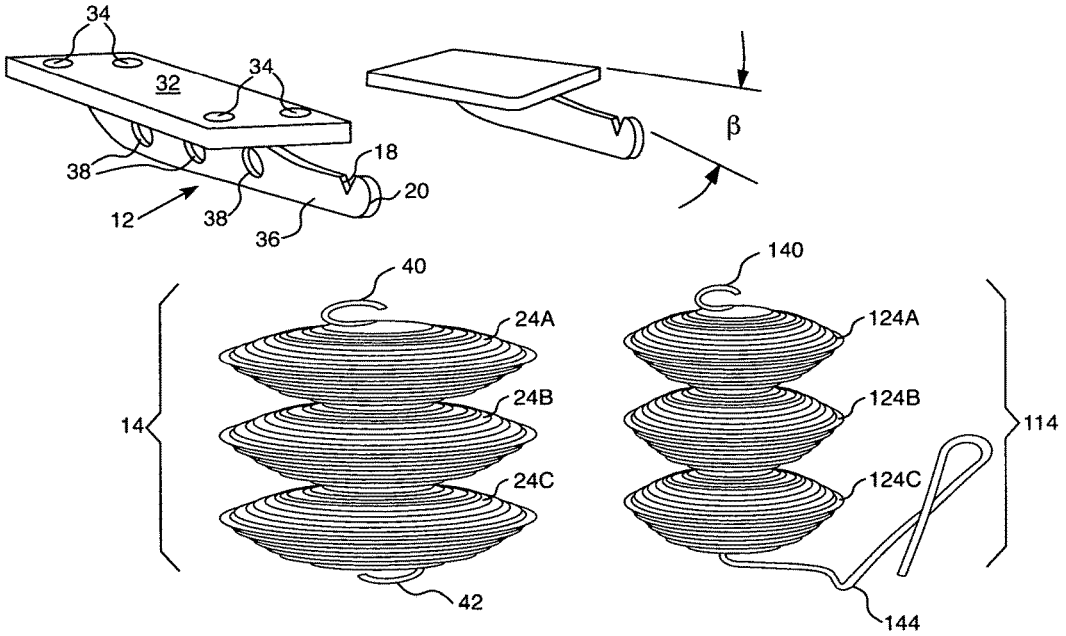
FIG. 3 are perspective views of a torsion arm, a bottom mounted coil section and a connecting rod-mounted variation of coil section according to this invention.

FIG. 3 shows a representative torsion arm 12 as would be made from materials such as metal, wood, or composite. That torsion arm has a flattened plane component 32 with apertures 34 through which screws or other fasteners connect torsion arm 12 to the underside of a guitar G. As for the arm element 36, note the V-groove 18 at end 20 of the torsion arm 12 with a plurality of weight lightening holes 38 added.

It should be noted first, that an alternate variety of torsion arm can be similarly shaped, though made from wood (or possibly even composite materials). But, the torsion arm can be customized for attaching to the guitar interior I at a variety of angles. First, there is the angle α (in FIG. 1) that CAN range from about 5 to 175 degrees from the horizontal plane of sound bridge SB. For illustration purposes, however, a 90 degree mounting angle is shown in FIG. 1.

Secondly, the angled summary to the right of torsion arm 12 in FIG. 3 shows yet a second variation in angle mountings, that angle β, ranging from about 5 to 89 degrees on either side of perpendicular, may be used for preferential positioning of any one or more torsion arms relative to the longitudinal directional plane of guitar string attachment. In the actual depiction of angle β in FIG. 3, however, the arm element 36 runs fully perpendicular to, or at 90 degrees, relative to plane component 32, as shown.

FIG. 3 shows two representative "styles" of involute coil sets, the first, item 14, is from the earlier shown FIG. 2 but with only three (3) frequency sets 24A, 24B and 24C. A top hook 40 connects this first variation to the V-groove 18 in torsion arm 12 while a lowermost arm hook 30 can be used for connecting the whole coil set directly to the guitar's rear wall W, a lower arm hook AH, or to an intermediate fastening arm/block F.

To the right of involute coil set 14 in FIG. 3, there is shown a first alternative embodiment (with common components commonly numbered though in the next hundred series). Particularly, that first alternative 114 is made of three (representative) frequency sets 124A, 124B and 124C and further includes a top hanging hook 140. But instead of a lower hook, this alternate variation includes a wire extension 144 that is intended to interact (i.e., connect) with a connecting rod (as better seen in FIGS. 4 and 5).

Figure 5:
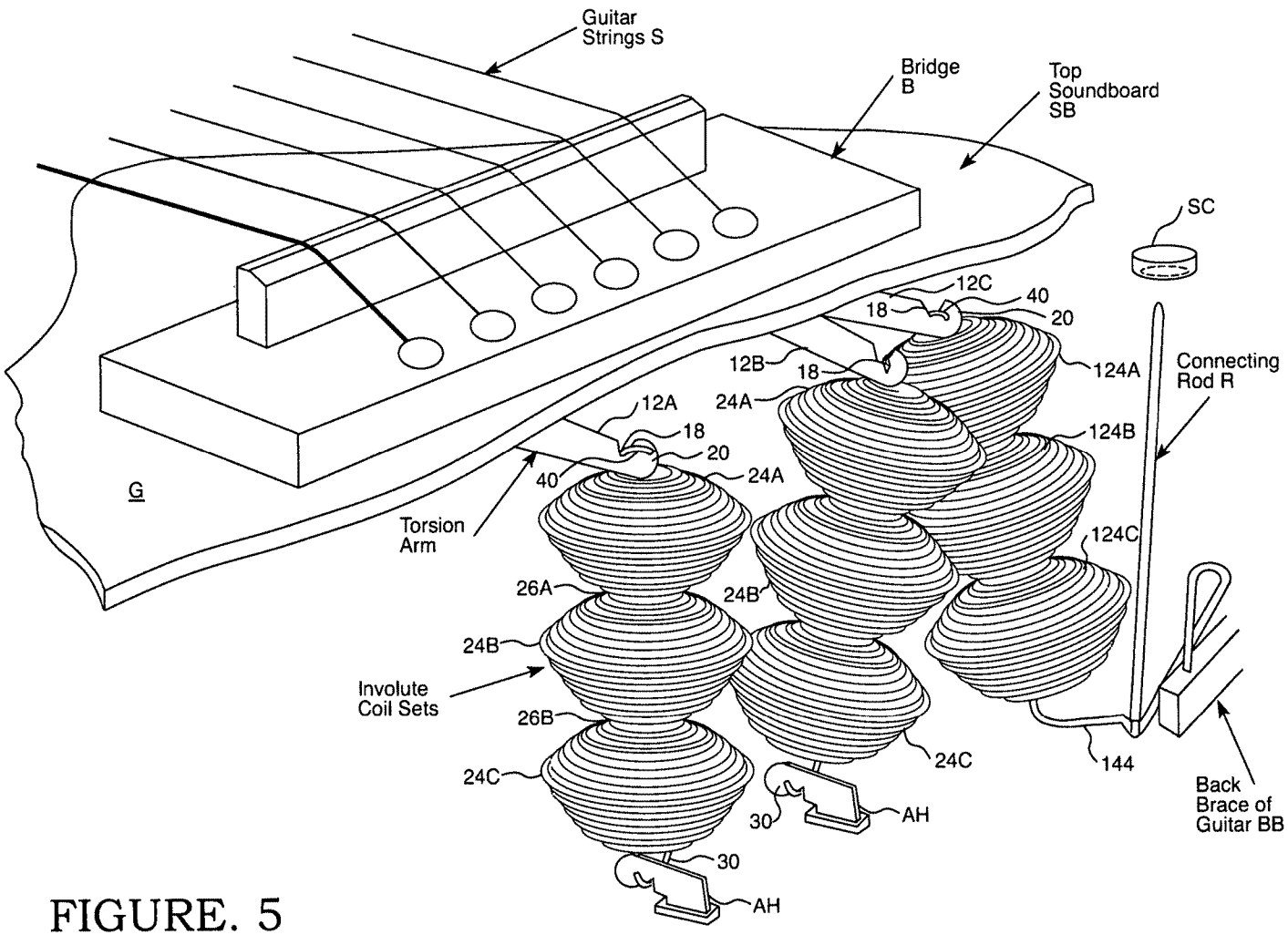
FIG. 5 is an exploded, perspective view showing a plurality of coil sections mounted at one end to the top soundboard of a representative six-string guitar.

Finally, FIG. 5 shows in true perspective fashion, a plurality of involute coil sets, actually two sets like component 14 in FIG. 3 and a third like component 114 therein as would be mounted to respective torsion arms 12A, 12B and 12C beneath soundboard SB and beneath bridge B of guitar G to which six plucking strings S are connected. Note how third involute coil set 114 has its wire extension 144 that fits at least partially into a back brace BB for the guitar interior with its own connecting rod R (and spacer/connector SC) accompanying the same.

Though the resonator device of this invention is shown attached to a typical acoustic guitar, the device may also be used with other string instruments such as violins, mandolins, basses, etc.

This device was first purposed for the sound reproduction qualities that are (in and of themselves) very unique and long overdue. In its concept, however, it also serves the dual function of lessening torsion stresses on the guitar's bridge area, an infamously well-known headache for guitar manufacturers. That is where traditional bridgework often pulls away from and/or physically distorts the soundboard over an instrument's lifetime. The design of this invention greatly reduces the stresses on those areas for many musical instrument applications. It re-directs these traditionally unwanted stresses into a shock absorption-and-transfer mechanism that not only cancels out a large percentage of such torsional stresses on the bridge area, but also better utilizes previous wasted energies in achieving beneficial harmonics amplification and sound wave sustain/boosting efficiencies.

Overall, the two-fold intent behind this resonator system enhancement is to:

1. capture and utilize previous wasted energies coming from the vibrating strings and transfer that energy in varying harmonic time lags to the back sound board, back to the top soundboard, etc., etc., thereby richly adding to the harmonic resonance of the frequencies being played on the surface, and 2. counter a substantial portion of the harmful moment-arm stresses acting upon the delicate bridge area of traditional instruments.

In doing so, this concept: helps produce a better free-floating membrane; allows for lighter, more delicate construction characteristics of the front soundboard, which leads to greater sound amplification and clarity; while further expanding the frequency response on the initial vibrations themselves, where the top soundboard clarity and amplification are increased even when effects are dampened.

In addition to the foregoing main benefits, this invention achieves limitless organic 'textural' effects through this breakthrough marriage of innovative physics. Thanks to these layered/involute coil designs, it is possible to produce much more than just a single frequency sustain. An unlimited variety of tonal 'textures' can now be achieved simply by incorporating any number of complimentary combinations of such layered resonators, adjusting their coil shape, size and gauge. Then further harmonizing the number of such resonator sets that can be blended into each unit.

One of the basic principles of resonance, called "sympathetic vibrations", states that a vibrating body of one frequency, i.e., the transmitter, will transfer its own vibrations through air (or through transmittal objects with a solid mass) to a nearby body with the same frequency characteristics, the receiver, causing that secondary receiving object (or objects) to vibrate in unison with the sender. This inventive design incorporates an involute form, offering an infinite number of receivers (and secondary transmitters) for such frequencies.

The acoustic behavior behind this design's special "layered" resonator construct has a unique and beneficial quality. The infinitely varying coil diameters and its unique pitch between coil waves (or its "spreads") result in a sound interaction not found with ordinary reverberating springs. These new resonator designs can mimic and reflect any frequency being created within the instrument including what guitarists understand as "bent" notes. In other words, the frequencies achievable herewith are not limited to what a routine single diameter coil winding is narrowly able to imitate.

The infinitely varying layers of these spiraled coil sets will also react with one another in a way where they can "bounce against one another" adding very slight but discernible "chorus", "tremolo", "warmth" and other octave enhancing effects adding "textures", making the final result much more "interlaced with sound" than a simple monotone sustain. Each varying resonator, its gauge, and each stacked layer thereof then act as a separate and individually unique contributing "delay wave" in reaction to any of the given frequencies produced on the surface strings of said guitar. The cumulative effect adds a "warmth" that is pleasantly unprecedented in an organic, acoustic instrument.

We claim:

1. A sound resonator device for a new or existing musical instrument that has a plurality of strings tensioned over a bridge piece connected to a soundboard, said soundboard having an interior face and an exterior face, said resonator device comprising:

(a) a torsion arm affixed at an angle between about 10 and 170 degrees to the interior face of the soundboard below or near the bridge piece; and (b) a plurality of involute coil sets, each coil set including a first component that spirals inwardly and integrally connects to a second component that spirals outwardly to form a harmonic section that is capable of capturing a range of frequency energies when one or more of the plurality of strings are played for delayed redistribution to another area of the soundboard, said plurality of involute coil sets being connected at a first end to the torsion arm.

2. The resonator device of claim 1 wherein the plurality of involute coil sets includes two or more harmonic sections.

3. The resonator device of claim 1 wherein the torsion arm connects directly to an uppermost end of the first component to the plurality of involute coil sets.

4. The resonator device of claim 1 wherein the plurality of involute coil sets attaches at a second end, opposite the first end, to an interior rear face of the instrument.

5. The resonator device of claim 4 wherein the plurality of involute coil sets attaches to the second end at an angle substantially perpendicular to the interior rear face of the instrument.

6. The resonator device of claim 1 wherein the plurality of involute coil sets attaches at a second end, opposite the first end, to a connecting rod that extends between the interior face of the soundboard and an interior rear face of the instrument.

7. The resonator device of claim 6 wherein the plurality of involute coil sets attaches to the connecting rod at an angle relative to perpendicular between the interior face of the soundboard and the interior rear face of the instrument.

8. The resonator device of claim 7 wherein the plurality of involute coil sets attaches to the connecting rod at about a 5 to 15 degree angle relative to perpendicular.

9. The resonator device of claim 1 wherein the torsion arm connects to two or more involute coil sets.

10. The resonator device of claim 1 wherein at least one torsion arm captures frequency energies from two or more of the plurality of strings of the musical instrument.

11. The resonator device of claim 1 wherein the musical instrument is an acoustic guitar.

12. The resonator device of claim 11 wherein the acoustic guitar is a six-string guitar having three torsion arms.

13. The resonator device of claim 12 wherein the acoustic guitar includes a first torsion arm for a B and a high E string, a second torsion arm for a D and a G string and a third torsion arm for a low E and an A string.

14. The resonator device of claim 1 wherein the musical instrument is an instrument selected from the group consisting of a banjo, a violin, a bass, a cello, a mandolin, a fiddle and a ukulele.

15. The resonator device of claim 1 wherein the involute coil set is made from a metal alloy selected from the group consisting of phosphor bronze, steel, copper and aluminum.

16. The resonator device of claim 1 wherein the torsion arm is made from wood.

17. The resonator device of claim 1 wherein the torsion arm is made from metal.

18. The resonator device of claim 1 wherein the torsion arm is made from a composite material.

* * * * *